US007750302B2

(12) United States Patent
Jamaluddin et al.

(10) Patent No.: US 7,750,302 B2
(45) Date of Patent: Jul. 6, 2010

(54) METHOD AND APPARATUS FOR DETECTING NAPHTHENIC ACIDS

(75) Inventors: Abul K. M. Jamaluddin, Kuala Lumpur (MY); Stephane Vannuffelen, Southampton (GB); Oliver C. Mullins, Ridgefield, CT (US)

(73) Assignee: Schlumberger Technology Corporation, Cambridge, MA (US)

( * ) Notice: Subject to any disclaimer, the term of this patent is extended or adjusted under 35 U.S.C. 154(b) by 0 days.

(21) Appl. No.: 12/206,805

(22) Filed: Sep. 9, 2008

(65) Prior Publication Data

US 2010/0059669 A1 Mar. 11, 2010

(51) Int. Cl.
*G01J 5/58* (2006.01)

(52) U.S. Cl. ..... 250/339.12; 250/269.1

(58) Field of Classification Search ..... 250/253, 250/256, 258, 269.1, 265, 339.11, 341.8, 250/254, 255, 257, 259, 339.12, 343; 356/70; 73/152

See application file for complete search history.

(56) References Cited

U.S. PATENT DOCUMENTS 4,860,581 A 8/1989 Zimmerman et al.
4,994,671 A 2/1991 Safinya et al.
6,096,196 A 8/2000 Varadaraj et al.
6,281,328 B1 8/2001 Sartori et al.
6,388,251 B1 * 5/2002 Papanyan ..... 250/269.1
6,437,326 B1 8/2002 Yamate et al.
6,768,105 B2 7/2004 Mullins et al.
7,160,728 B2 1/2007 Chimenti et al.
7,362,422 B2 4/2008 DiFoggio et al.
2002/0043620 A1 * 4/2002 Tchakarov et al. ..... 250/269.1
2002/0197725 A1 * 12/2002 Eaton et al. ..... 436/104
2004/0106204 A1 * 6/2004 Chimenti et al. ..... 436/55
2004/0211906 A1 * 10/2004 Lendl ..... 250/343
2007/0298505 A1 12/2007 Smith et al.

OTHER PUBLICATIONS

Yen T.W., Marsh W.P., MacKinnon M.D., Fedorak P.M.; Measuring Naphthenic Acids Concentrations in Aqueous Environmental Samples by Liquid Chromatography; 2004; Journal of Chromatography A; vol. 1033; pp. 83-90.*

Scott A.C., Young R.F., Fedorak P.M.; Comparison of GC-MS and FTIR Methods for Quantifying Naphthenic Acids in Water Samples; 2008; Chemosphere; vol. 73; pp. 1258-1264.*

Betancourt, S., et al., Analyzing Hydrocarbons in the Borehole, Schlumberger Oilfield Review, Autumn 2003, pp. 54-61, vol. 15, No. 3 .

Bitsch-Larsen, A., et al., Simple Method to Determine the Partition Coefficient of Naphthenic Acid in Oil/Water, Journal of Chemical & Engineering Data, 10.1021/je800287f CCC, Published on Web Sep. 4, 2008, http://pubs.acs.org/cgi-bin/asap.cgi/jceaax/asap/html/je800287f.html, American Chemical Society.

* cited by examiner

*Primary Examiner*—David P Porta
*Assistant Examiner*—David S Baker
(74) *Attorney, Agent, or Firm*—Helene Raybaud; Vincent Loccisano; James McAleenan

(57) ABSTRACT

A method and apparatus for determining the concentration of organic acids in formation fluids is provided including pumps for pumping fluids from a subterranean formation into the body of a downhole tool and sources for illuminating the flow with infrared radiation to obtain the infrared absorption or a related parameter at one or more wavelengths, and processors for converting the measured absorption into the concentration of the organic acids, using for example a multi-value calibration matrix which relates IR absorption spectral values to concentration measurement under downhole conditions.

12 Claims, 4 Drawing Sheets

METHOD AND APPARATUS FOR DETECTING NAPHTHENIC ACIDS

FIELD OF THE INVENTION

This invention is generally related to methods and apparatus for detecting the presence and/or measuring the amounts of naphthenic acids in formation fluids, particularly in effluents of hydrocarbon reservoirs.

BACKGROUND

Naphthenic acids are usually defined as a monobasic carboxyl group attached to a saturated cycloaliphatic structure. The molecular formula is given by $C_NH_{2N+I}O_2$ where I is −2 for monocyclic acids and −4 for bicyclic acids. It has been accepted in the oil industry that almost all organic acids in crude oil are called naphthenic acids. Naphthenic acids in crude oils are mixtures of low to high molecular weights varying from approximately 100 to greater than 1300 units.

Naphthenic acids are recognized for their corrosive behavior and as an initiator of fouling, emulsifying and other undesired reaction during production and at the refinery stages. Some organic acids are thought to arise from the biodegradation process. This process has a large impact on oil viscosity and thus on oil flow rate and ultimately the economic gains from the oil production. The extent of biodegradation in oil columns is highly variable depending on many factors such as temperature, geologic history, distance to the oil-water contact etc.

It is thus seen as desirable to have the ability to measure or estimate the presence and concentration of naphthenic acids in reservoirs fluids. Early knowledge of the concentration of naphthenic acid can be used, for example, in field development plans which integrate the technical and economic aspects of drilling production wells and installing production facilities.

The current methods for assessing or the screening of oil samples for naphthenic acid as reflected, for example, in U.S. Pat. No. 6,281,328 to Satori et al., U.S. Pat. No. 7,160,728 to Chimenti et al., or published U.S. Patent Application No. 2007/0298505 involve either a titration method (TAN) or various spectroscopic methods, including mass spectroscopy (MS), infrared spectroscopy (IR), ultra-violet spectroscopy (UV), or nuclear magnetic resonance (NMR). As described in these and other sources, including for example, "Simple Method to Determine Partition Coefficient of Naphthenic Acid in Oil/Water" by Anders Bitsch-Larsen and Simon Ivar Andersen, to be published in the Journal of Chemical and Engineering Data, IR methods are usually based on measuring the absorption or reflectance at 1708 cm-1 (carboxylic or C═O band) or, to a lesser degree at 1728 cm-1 or 1637 cm-1. The methods as described are typically performed in a laboratory under ambient conditions.

It is further known to analyze formation fluid in the borehole using downhole analyzing tools such as the CFA™ of Schlumberger. The CFA is described, for example, in the Oilfield Review, Autumn 2003 issue, pp. 54-61, in co-owned U.S. Pat. Nos. 6,437,326 to Yamate and Mullins and 6,768,105 to Mullins et al., and a similar type of downhole analysis tool is described in the U.S. Pat. No. 7,362,422 to DiFoggio and Bergren. Known downhole instruments are designed to be carried downhole on a tool string such as the Schlumberger's MDT™ and are able to analyze fluid flow through the tool in the visible and near-infrared range of the electromagnetic spectrum.

In view of the known art, it is seen as one object of the invention to provide a method and apparatus for determining the presence and/or concentration of naphthenic acids in formation fluids at a downhole location.

SUMMARY OF INVENTION

According to a first aspect of the invention, a method of determining the concentration of organic acids in formation fluids is provided using the steps of pumping fluids from a subterranean formation into the body of a downhole tool and illuminating the flow with infrared radiation to obtain an infrared absorption or a related parameter at one or more wavelengths, and converting the measured absorption into the concentration of the organic acids, using for example a multi-value calibration matrix which links IR absorption spectral values to concentration measurements under downhole conditions.

The organic acids detected by the method are preferably naphthenic acids.

The infrared radiation is preferably radiation in the mid-IR range of 30 μm-1.4 μm (4000-400 $cm^{-1}$) and is emitted into the flow either by transmission or using internal reflections at an interface with the flow.

In a preferred variant of the method, absorption parameters as measured through the downhole IR spectroscopy are converted into concentrations using a calibration derived from absorption values of mixtures with known concentrations of the organic acid. In an even more preferred variant, spectroscopic measurements performed on the flow are converted into Total Acid Numbers (TANs) to characterize the formation hydrocarbons.

A further aspect of the invention relates to an apparatus for determining the content of organic acids in formation fluids, the apparatus including a flow line for letting the formation fluids flow from a downhole formation through a body of the apparatus at a downhole location, one or more sources of infrared radiation for radiating flow in the flow line with infrared radiation; one or more detectors to obtain absorption parameters at one or more wavelengths, and a processor for determining the concentration of said organic acid by converting said absorption parameters.

Whilst it is preferred that the all of the above elements are part of a tool located during operation in a well, it can be envisaged that part of the processing elements may be located during operations on a surface location.

Further details, examples and aspects of the invention will be described below referring to the following drawings.

DETAILED DESCRIPTION

Figure 1:
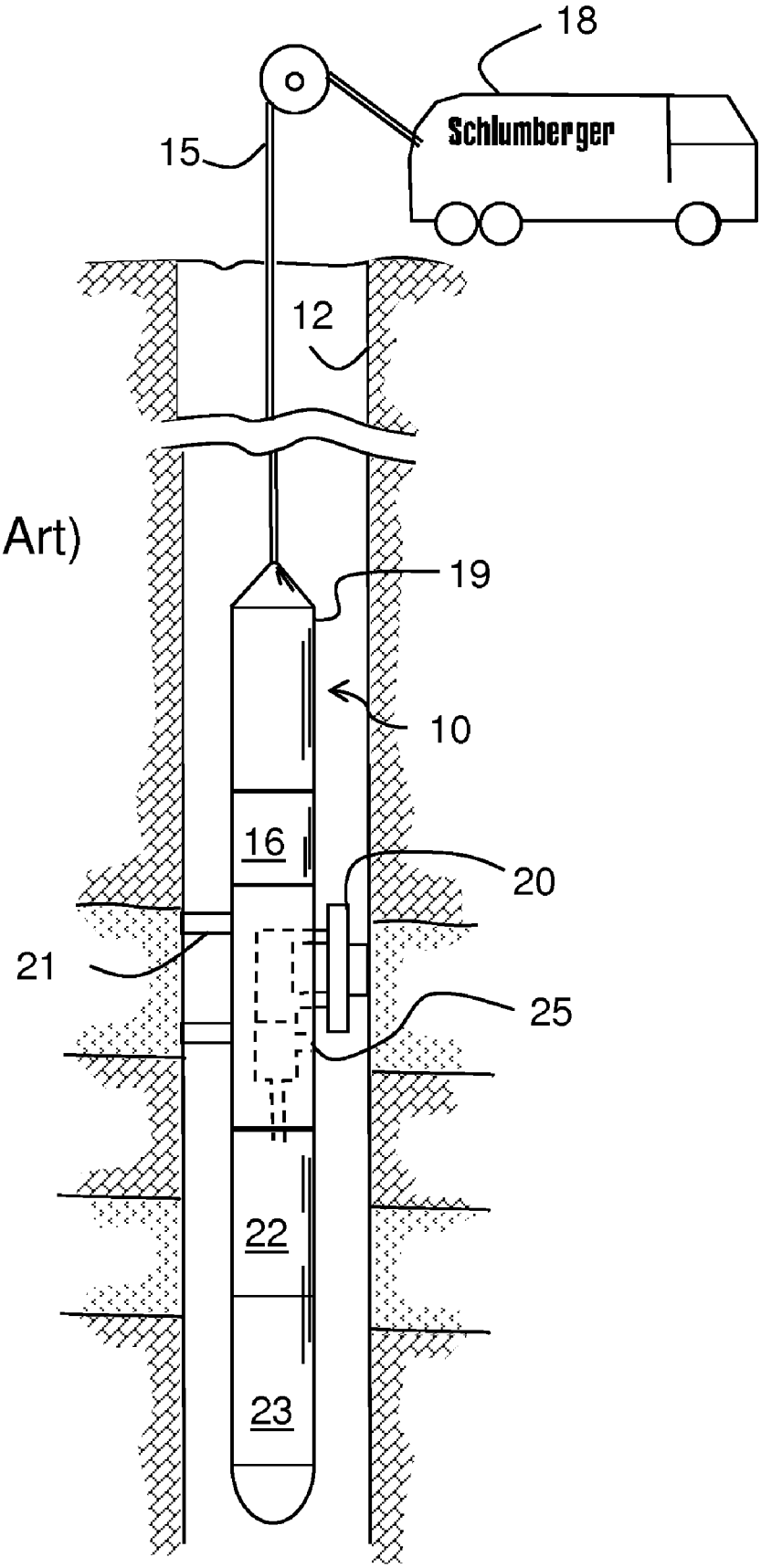
Fig. 1(Prior Art)
FIG. 1 shows a downhole testing or sampling device.

In FIG. 1 there is shown a downhole tool 10 suspended in the borehole 12 from the lower end of a logging cable 15 that is connected in a known fashion using wireline or coiled tubing to a surface system 18 incorporating appropriate electronics and processing systems for control of the tool. The tool 10 includes an elongated body 19 which encloses the downhole portion of the tool control system 16. The body 19 also carries a selectively extendible fluid admitting assembly 20 (for example as described in U.S. Pat. No. 4,860,581, incorporated herein by reference) and a selectively extendible anchoring member 21 which are respectively arranged on opposite sides of the body 19.

The fluid admitting assembly 20 is equipped for selectively sealing off or isolating portions of the wall of the borehole 12 such that pressure or fluid communication with the adjacent earth formation is established. A fluid analysis module 25 is also included within the tool body 19, through which the obtained fluid flows. The fluid can then be expelled through a port (not shown) back into the borehole, or can be sent to one or more sample chambers 22, 23 for recovery at the surface.

Control of the fluid admitting assembly, the fluid analysis section and the flow path to the sample chambers is maintained by the control systems 16, 18 that may utilize electrical or fiber optic data telemetry architectures.

The fluid analysis module 25 as found in the MDT mentioned above, determines the identity of the fluids in the MDT flow stream and quantifies the oil and water content. In particular, U.S. Pat. No. 4,994,671 (incorporated herein by reference) describes a borehole apparatus which includes a testing chamber, means for directing a sample of fluid into the chamber, a light source preferably emitting infrared rays, a spectral detector, a data base means, and a processing means. Fluids drawn from the formation into the testing chamber are analyzed by directing the light at the fluids, detecting the spectrum of the transmitted and/or backscattered light, and processing the information accordingly (and preferably based on the information in the data base relating to different spectra), in order to quantify the amount of water and oil in the fluid. Thus, the formation oil can be properly analyzed and quantified by type.

Figure 2A:
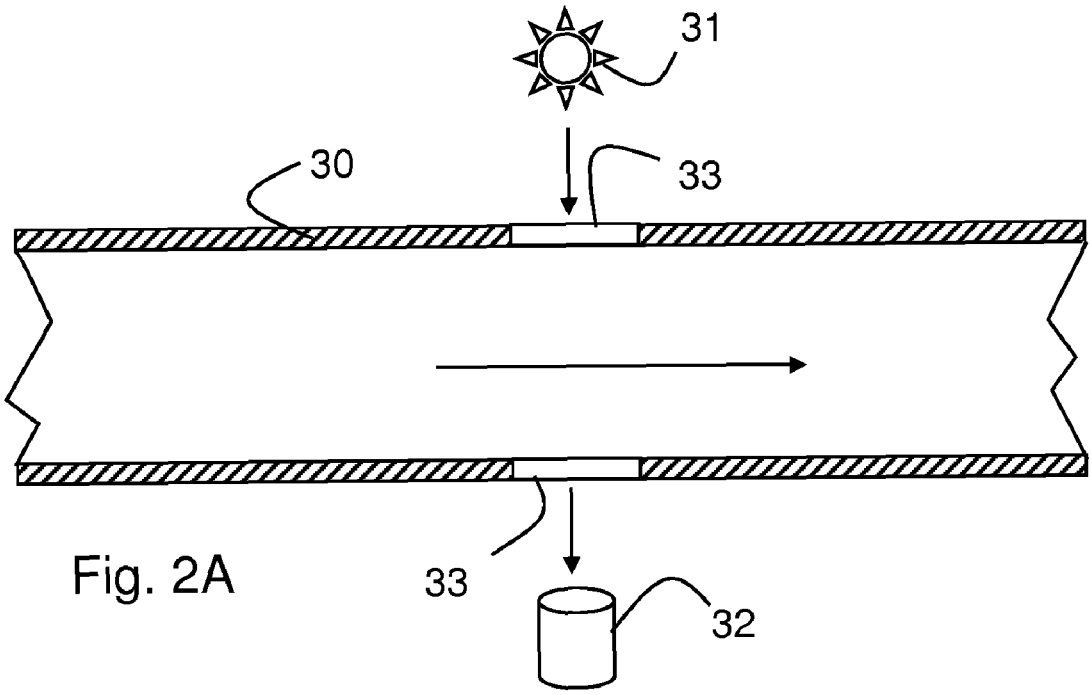
FIG. 2A illustrates a spectrometric tool and method in accordance with a first example of the invention.
Figure 2B:
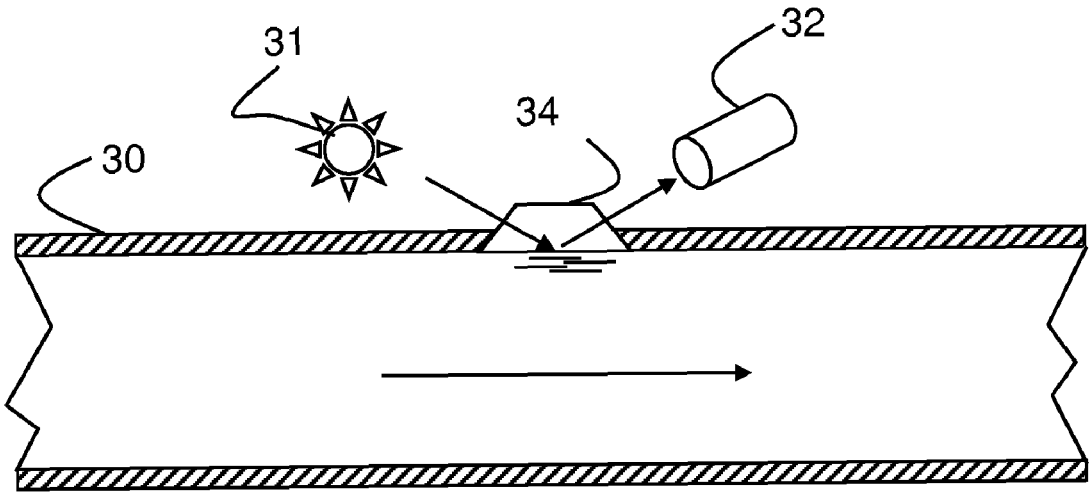
FIG. 2B illustrates a spectrometric tool and method in accordance with a second example of the invention.

The following FIGS. 2A and 2B illustrate two different variants of the IR measurement, transmission spectroscopy and attenuated total internal reflectance (ATR). In both variants the sample flows through a pipe 30 connected to the fluid admitting assembly 20 of the device of FIG. 1 or a similar device. Further common elements in both variants are one or more sources 31 of mid-IR emissions and one or more detectors 32.

For example, typical blackbody sources can be used as a source to generate IR radiation as is well known. A standard IR source is a glow bar. Glow-bars are round rods with a thin resistance incandescent part in the middle and thicker metallized ends for the supply connections. The rods are made of silicon carbide. By varying the current through the glow bar it is possible to set the temperature of the part from 1000 to 1500 K. The corresponding maximum emission is given by Wiens displacement law where the wavelength of maximum emission (in cm) is roughly given by (0.3)/T where T is temperature. At 1000 K, the maximum emission is 3 microns, very close to the carbonyl band.

In an alternative arrangement (not shown), the source can be one beam of a Fourier Transform IR spectrometer. In such a spectrometer a single IR beam is split into two beams using a partial reflector. The path length of one of these beams is then altered and afterwards the beams are recombined coherently. For a single frequency, sweeping the pathlength causes the coherent recombination to alternate between in phase and out of phase addition giving the characteristic beat pattern. For multiple frequencies one obtains a superposition of beat frequencies. Placing the sample in one of the beam paths causes optical absorption at particular frequencies such as at the carbonyl absorption frequency. This frequency appears then preferentially removed from the beat pattern. Fourier transform IR spectroscopy is a routine measurement in surface laboratories and allows rapid spectral measurements to be made.

Given that the mid-IR carbonyl bands are strong absorbers, naphthenic acids can be present in the sample in low or high concentrations. As the overall optical absorption is the product of the concentration times the absorption strength, acids can be detected using either through a transmission or reflectance methods.

If only low concentrations of organic acids are present in the sample flow, then transmission spectroscopy is likely preferred where an IR beam traverses the sample as illustrated by the configuration of FIG. 2A. A beam of IR light passed through windows 33 of, for example, quartz or sapphire in the pipe and the flow, while the detectors 32 register the intensity of the transmitted radiation at one or more or even a continuum of wavenumbers or frequency. The spectrum is for practical purposes divided into measuring channels, each represented by a wavenumber.

If the concentration of organic acids is sufficiently high, then it is anticipated that an ATR method may be applied where much shorter path lengths of the solution are investigated. In ATR methods the IR beam is launched in a prismatic window 34 of IR transparent material, e.g. quartz or sapphire at an angle such that the beam undergoes total internal reflection at the window-flowstream interface. The beam intensity can be reduced if the evanescent field is absorbed by species in the flow line. By measuring absorption versus wavelength an ATR optical absorption spectrum can be measured. In addition, it is also known that organic acids are highly interfacially active. Consequently, one can use an optical window of sapphire or quartz where ionic interfacial compounds such as organic acids might accumulate. Such a process assists with detection of the acids.

The performance of the methods as described above can be improved by further steps. For example, in the presence of many components in the flow, the detection of naphthenic acids in the flow can become more difficult even if the IR spectrum is registered at many different wavelengths. To overcome this problem a multi-wavelengths calibration regression method such as the known PCA (Principal Component Analysis) or PCR (Principal Component Regression) can be applied. The application of such a method is described in FIGS. 3 and 4.

Figure 3:
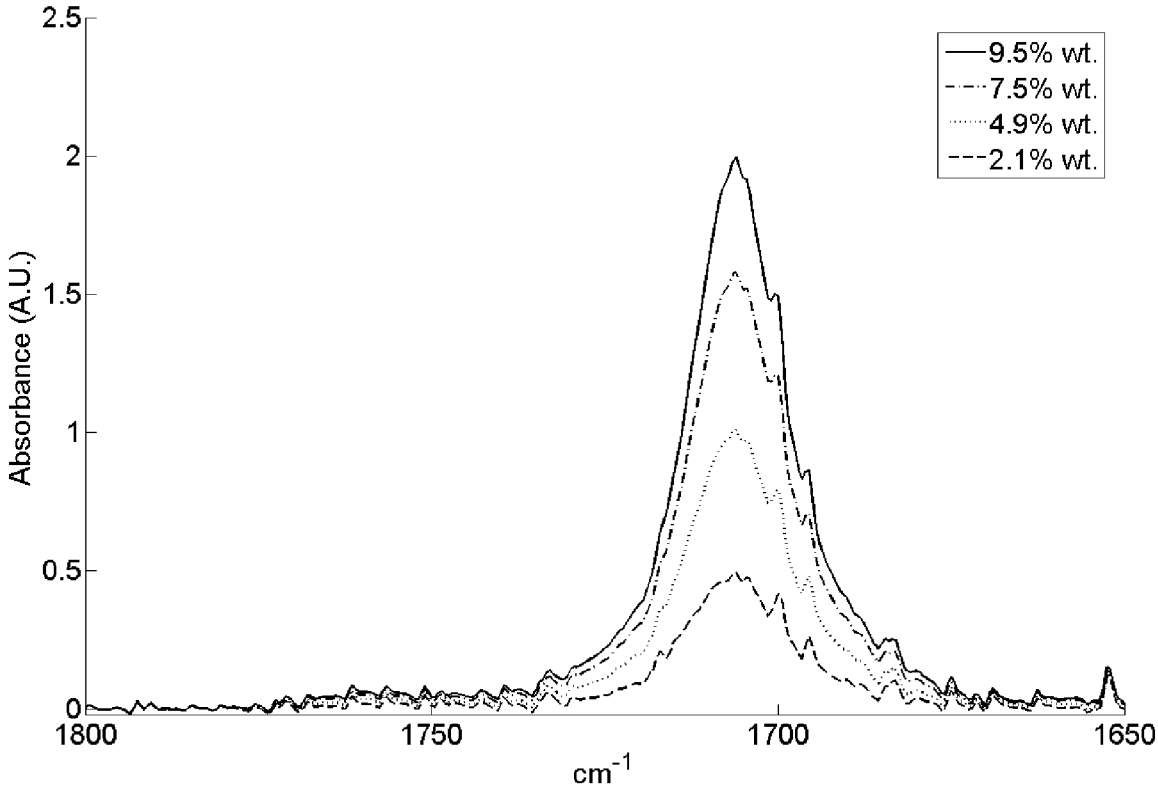
Fig. 3 (Prior Art)
FIG. 3 illustrates spectroscopic scans showing absorbance variance as a function of naphthenic acid concentrations.

As naphthenic acids have a broad IR spectrum with several peaks as shown in FIG. 3, the absorption spectrum can be sampled at different wavelengths. Modern downhole spectrometers operating in the optical and near-IR range can provide between 16 and 20 channels in this range. The optical resolution is in the range of 0.5 $cm^{-1}$.

Figure 4:
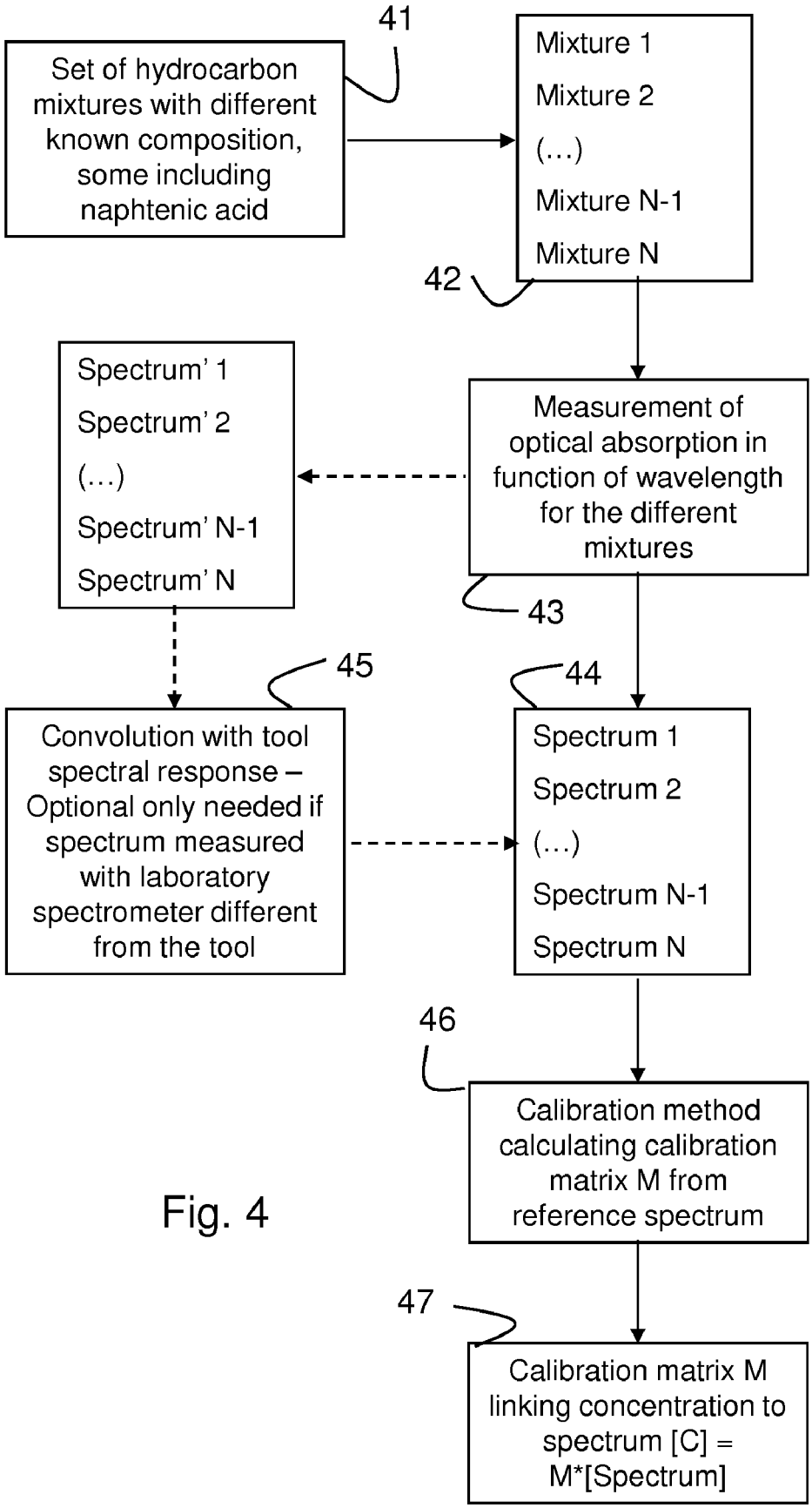
FIG. 4 illustrates steps to calculate a calibration matrix for downhole measurements of fluids comprising naphthenic acids.

As illustrated by FIG. 4, a calibration matrix can obtained from a set of experimental spectrum measurement 43, 44 with different known concentrations for the different components of the mixture including naphthenic acids (Steps 41, 42). If these measurements are performed using an IR spectrometer different from the one downhole or under different pressure or temperature conditions, the spectra as measured can be convolved 45 with an appropriate tool response function to determine spectra as measured at a downhole location. The spectra can be solved 46 for the concentration of the original mixtures resulting in a calibration matrix 47 for naphthenic acids, which when applied to an unknown spectrum transforms the spectrum into concentration values for naphthenic acids.

Due to the linear relationship between absorption and concentration, the equation system is essentially linear and therefore, in theory four absorption measurements and hence a 4×4 calibration matrix would be enough for the estimation of four composition parameters corresponding to C1, C2, C3-C5 and C6+, where Cn denotes the number of carbon atoms of the species measured. Using more wavelengths makes the calculation more robust against noise, instrument drift, and other errors.

Using more wavelengths also allows the calculation of concentration of other species as long as their spectrum is distinct from the oil components one. Given the clear distinction between absorption spectrum of the purely hydrocarbon phase of oil and naphthenic acid, the calibration matrix can be extended to include other components of the sampled reservoir fluid. Therefore, by introducing in the calibration set mixtures with naphthenic acid and for example low molecular weight fractions of hydrocarbons such as C1, C2, C3-C5 and C6+ and using the same calibration method as before a new calibration matrix can be calculated. This matrix will allow the calculation of naphthenic acid and C1, C2, C3-C5 and C6+ concentrations.

Again to be accurate, the calibration of spectroscopic response using known concentrations of naphthenic acid in hydrocarbon oil requires measurements at downhole temperature, pressure and pH conditions or a suitable tool response function which transforms the spectroscopic measurement between laboratory conditions and downhole conditions.

Spectral tools and measurements as described above can be used to quantify the concentration of unknown naphthenic acid concentrations in hydrocarbon oil while the spectroscope is downhole.

In a further optional step these naphthenic acid measurements downhole are then correlated to estimate the total-acid number (TAN) of the hydrocarbon oil as produced from the formation. The TAN can be used in the downstream or refining industry as a parameter to determine the commercial value of the produced oil or as a parameter to determine the further processing of the crude oil.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative processes, one skilled in the art will recognize that the system may be embodied using a variety of specific procedures and equipment and could be performed to evaluate widely different types of applications and associated geological intervals. Accordingly, the invention should not be viewed as limited except by the scope of the appended claims.

What is claimed is:

1. A method of determining the concentration of naphthenic acids in formation fluids, said method comprising the steps of:

allowing said formation fluids to flow through a body of a downhole tool;

radiating said flow with infrared radiation to obtain infrared absorption parameters at one or more wavelengths under downhole conditions, and determining the concentration of said naphthenic acid by converting said absorption parameters.

2. The method of claim 1 wherein the infrared radiation is radiation in the mid-IR range of 30 μm-1.4 μm.

3. The method of claim 1 wherein the infrared radiation is transmitted through the flow.

4. The method of claim 1 wherein the infrared radiation is reflected from an interface with the flow.

5. The method of claim 1 wherein the absorption parameters are converted into concentrations using a calibration derived from absorption values of mixtures with known concentrations of the naphthenic acid.

6. The method of claim 1 further comprising the step of determining the concentrations of the naphthenic acid and of hydrocarbons in the fluid.

7. The method of claim 1 further comprising the step of determining the total acid number (TAN) of the fluid.

8. An apparatus for determining the concentration of naphthenic acids in formation fluids, said apparatus comprising a flow line for allowing said formation fluids to flow from a downhole formation through a body of said apparatus at a downhole location;

one or more sources of infrared radiation for radiating flow in said flow line with infrared radiation;

one or more detectors to obtain absorption parameters at one or more wavelengths under downhole conditions, and a processor for determining the concentration of said naphthenic acid by converting said absorption parameters.

9. The apparatus of claim 8 wherein the infrared radiation is radiation in the mid-IR range of 30 μm-1.4 μm.

10. The apparatus of claim 8 wherein the infrared radiation is transmitted through the flow.

11. The apparatus of claim 8 wherein the infrared radiation is reflected from an interface with the flow.

12. The apparatus of claim 8 wherein the absorption parameters are converted into concentrations using a calibration derived from absorption values of mixtures with known concentrations of the naphthenic acid.

* * * * *